US012747539B2

(12) United States Patent
Heiskanen et al.

(10) Patent No.: US 12,747,539 B2
(45) Date of Patent: Sep. 29, 2026

(54) MULTI-PLY LINER WITH WASHED NSSC PULP

(71) Applicant: Stora Enso OYJ, Helsinki (FI)

(72) Inventors: Isto Heiskanen, Imatra (FI); Jukka Kankkunen, Imatra (FI); Jukka Lyyra, Jämsä (FI); Harri Taipale, Vantaa (FI)

(73) Assignee: Stora Enso OYJ, Helsinki (FI)

( * ) Notice: Subject to any disclaimer, the term of this patent is extended or adjusted under 35 U.S.C. 154(b) by 112 days.

(21) Appl. No.: 18/877,515

(22) PCT Filed: Jun. 28, 2023

(86) PCT No.: PCT/IB2023/056701
§ 371 (c)(1),
(2) Date: Dec. 20, 2024

(87) PCT Pub. No.: WO2024/009175
PCT Pub. Date: Jan. 11, 2024

(65) Prior Publication Data

US 2026/0218457 A1 Jul. 30, 2026

(30) Foreign Application Priority Data

Jul. 4, 2022 (SE) ..... 2230218-6

(51) Int. Cl.

| | |
|---|---|
| ***B65D 25/14*** | (2006.01) |
| ***B65D 65/40*** | (2006.01) |
| ***D21C 9/02*** | (2006.01) |
| ***D21H 11/04*** | (2006.01) |
| ***D21H 11/06*** | (2006.01) |
| ***D21H 27/10*** | (2006.01) |
| ***D21H 27/38*** | (2006.01) |

(52) U.S. Cl.
CPC ..... *D21H 27/38* (2013.01); *B65D 25/14* (2013.01); *B65D 65/40* (2013.01); *D21C 9/02* (2013.01); *D21H 11/04* (2013.01); *D21H 11/06* (2013.01); *D21H 27/10* (2013.01)

(58) Field of Classification Search
CPC ..... D21H 27/38; D21H 11/04; D21H 11/06; D21H 27/10; D21C 9/02; B65D 25/14; B65D 65/40
USPC ..... 206/524.2, 524.3, 524.9
See application file for complete search history.

(56) References Cited

U.S. PATENT DOCUMENTS 6,322,667 B1 * 11/2001 McCall ..... D21F 5/00 162/207
2010/0000693 A1 1/2010 Champ et al.
2011/0088860 A1 * 4/2011 Heijnesson-Hulten ..... D21H 13/00 162/164.1
2018/0051417 A1 2/2018 Harrington et al.
2019/0218716 A1 7/2019 Hoglund et al.
2021/0268783 A1 * 9/2021 Lampainen ..... D21H 11/18
2024/0240408 A1 * 7/2024 Heiskanen ..... D21H 11/06

FOREIGN PATENT DOCUMENTS

JP H11211783 A 8/1999

OTHER PUBLICATIONS

Extended European Search Report from corresponding European application No. 23835011.0, mailed May 11, 2026.
Valmet Oyj, Valmet to supply an upgrade of the washing process area for Stora Enso's Heinola fluting mill, in Finland, Jun. 17, 2017.
International Search Report from corresponding PCT application No. PCT/IB2023/056701, mailed Jul. 19, 2023.
Saara Hanhikoski et al., Biorefining of Scots pine using neutral sodium sulphite pulping: investigation of fibre and spent liquor compositions, Industrial Crops & Produts 129 (2019) 135-141.
Ali Salem Ali, Design of multilayer paperboard for optimised compression strength, Karlstad University, Faculty of Health, Science and Technology, 2020, DiVA, id: diva2: 1414179.
Mark J. Kirwan, Paper and Paperboard Packaging Technology, Blackwell Publishing, 2005.
Ali, S.A. Design of multilayer paperboard for optimized compression strength, Karlstad University, Faculty of Health, Science and Technology, 2020, 51 pages, DiVA ID: diva2:1414179.
Markaryd Compendium Y-204 "Semi-Chemical Pulp Neutral Sulphite Production", 1975, ISBN: 91-7322-023-x.
Valmet, Website https://www.valmet.com/pulp/mechanical-pulping/ as at Jul. 1, 2022, downloaded from the Internet Archive ("Wayback Machine", https://web.archive.org/) "NSSC (Neutral Sulphite Semi-Chemical) pulping".
Joachimiak et al. "Comparison of Miscanthus giganteus and birch wood NSSC pulping. Part 1: The effects of technological conditions on certain pulp properties." Wood Res 64.1; (2019): 49-58.
Tappi Over the Wire (internet publication), Table of Contents, and article "Stora Enso to Upgrade Washing Process Area at Heinola Fluting Mill in Finland"dated Jun. 8, 2017.
Valmet Marketing brochure with the title Excellent washing efficiencies and extremely low maintenance, dated 2016.
Laksono et al., "Pulp and Paper Properties of Jenitri Wood (Elaeocarpus ganitrus)." European Journal of Applied Science, Engineering and Technology 2.2 (2024): 22-31.

(Continued)

*Primary Examiner* — Jacob K Ackun
(74) *Attorney, Agent, or Firm* — Greer, Burns & Crain, Ltd.

(57) ABSTRACT

The present invention relates to a multi-ply liner for use in food or beverage packaging materials, said multi-ply liner comprising: a first ply, and a second ply, wherein said first ply comprises at least 70 wt % unbleached kraft pulp and less than 30 wt % neutral sulfite semi chemical (NSSC) pulp based on dry weight, wherein said second ply comprises at least 50 wt % NSSC pulp and less than 50 wt % unbleached kraft pulp based on dry weight, and wherein said NSSC pulp in the second ply is a washed NSSC pulp which has an ash content of less than 1.8 wt %, as determined according to standard ISO 1762:2019. The present invention further relates to a method for manufacturing said multi-ply liner.

22 Claims, No Drawings

(56) References Cited

OTHER PUBLICATIONS

Wikipedia page on Elaeocarpus ganitrus [https://sv.wikipedia.org/wiki/Elaeocarpus_ganitrus], retrieved Nov. 18, 2024.
STFI message series B No. 462 (TM 43) "T-Pulp project final report", the project was completed in Jun. 1977, and the report became publicly available two years later, i.e. Jun. 1979 (see p. 3, "1.1 T-Pulp Project").
Sixta, Herbert, ed. Handbook of pulp. John Wiley & Sons, 2006.
Markaryd Compendium Y-313 "Kraft paper and Kraftliner", 1990, ISBN: 91-7322-107-4.
Markaryd Compendium Y-206 "Washing of pulp", 1994, ISBN: 91-7322-174-0.
Opposition against Swedish priority application No. 2230218-6 dated Dec. 18, 2024.

* cited by examiner

MULTI-PLY LINER WITH WASHED NSSC PULP

This application is a U.S. National Phase under 35 U.S.C. § 371 of International Application No. PCT/IB2023/056701, filed Jun. 28, 2023, which claims priority under 35 U.S.C. §§ 119 and 365 to Swedish Application No. 2230218-6 filed Jul. 4, 2022.

TECHNICAL FIELD

The present invention relates to a multi-ply liner comprising NSSC pulp. The multi-ply liner may be used as a packaging material directly or as a component of corrugated board.

BACKGROUND

Liner, or linerboard, is a type of thin cardboard which may be used as a packaging material directly, for example as the paper or paperboard substrate for a packaging board, but is more commonly used as a component of corrugated board.

Corrugated board (sometimes referred to as corrugated cardboard or corrugated fiberboard) is a packaging material which can be converted to different types of packaging solutions. Corrugated board is a fiber based material made from cellulose fibers. The fibers can be virgin cellulose fibers or recycled cellulose fibers, such as fibers from used corrugated cardboard or other materials.

The corrugated board comprises at least one corrugated medium (fluting) and at least one non-corrugated medium (liner or linerboard) glued onto a surface of the corrugated medium. For example, the corrugated board may consist of a layer of fluting glued between two layers of liner to form a sandwich structure. The sandwich structure can be formed in different ways such as in single, double, and triple walls as described, e.g., in Kirwan M., J., Paper and Paperboard. Packaging Technology, Blackwell Publishing 2005.

There are different kinds of corrugated board qualities, and these may comprise different types of liners and corrugated media. Examples of liners are kraftliner and testliner. Kraftliner is typically produced from kraft pulp that can be bleached or unbleached and may comprise one or more layers/plies wherein the top layer/ply is often optimized to provide a good printing surface and good moisture resistance. Testliner is mainly produced from recycled corrugated board and is commonly manufactured in two layers/plies. Due to the presence of recycled cellulose fibers, testliner may typically have lower mechanical strength, particularly lower burst strength, than kraftliner. Kraftliner is frequently used in packaging boxes with higher demands on strength properties.

2-ply liners, such as test liner, having a top ply made from unbleached kraft pulp and a back ply with recycled cellulose fiber pulp typically have limited use in food packaging applications because of the poor mechanical properties and possibly high levels of contamination of the recycled cellulose fiber content. Paper or board for food packaging applications should preferably comply with the BfR XXXVI recommendations for paper and board for food contact as of Jan. 4, 2021.

Replacing the recycled cellulose fiber content with unbleached kraft pulp is not feasible due to the increased cost. The strength and mechanical properties of liner can be improved by adding small amounts of chemical pulp and unbleached kraft pulp to mechanical pulps. Typically, 5-15% chemical pulp is added. This of course adds costs but also leads to reduced dewatering speed and may also affect runnability and mechanical performance. Another solution is to wash the recycled cellulose fibers but that will also increase costs and may affect for example the burst strength properties of the liner.

New machine concepts and increased machine speeds, combined with increased demands for source reduction, has further increased the need for pulps with improved properties.

There remains a need for new and improved liner materials, useful as paper or paperboard substrates for a liquid packaging board (LPB) or a food service board (FSB) or as liners for corrugated board, that combine strength, low grammage, water/moisture resistance, low chemical consumption, low cost, and/or high recyclability.

DESCRIPTION OF THE INVENTION

It is an object of the present disclosure to provide an improved multi-ply liner, e.g. for use in corrugated board, which solves or ameliorates at least some of the above-mentioned problems.

It is a further object of the present disclosure to provide a method for manufacturing a multi-ply liner, which can reduce consumption of unbleached kraft pulp (UBKP) in the liner without losing the mechanical properties of a UBKP liner when used in a corrugated board.

The above-mentioned objects, as well as other objects as will be realized by the skilled person in the light of the present disclosure, are achieved by the various aspects of the present disclosure.

NSSC pulp is commonly used in fluting for corrugated board, but due to its optical and mechanical properties it is not used to the same extent in linerboard. A challenge with NSSC pulp is that the process is mainly designed for high yield and highly efficient processes. The main target is to provide a fiber or fiber suspension which meet the requirements for corrugated board/containerboard such as the use in fluting or corrugating medium. Furthermore, NSSC pulps often contain contaminants and organic and inorganic residues which make the pulps less suitable for food packaging applications. Additionally, the use of such NSSC pulps with high amounts of contaminants and or impurities require higher dosing of, e.g., slimicides, preservatives, dewatering accelerators, and/or retention agents, which can impact the wet end chemistry. Addition of NSSC pulp in liner production is known to have a great negative impact on wet end chemistry and to cause problems with webs breaks.

NSSC pulp, which is normally made from hardwood species, is noted for exceptional stiffness and high rigidity. Neutral Sulfite Semi-Chemical (NSSC) pulping is an old process that it is well known in the field of paper pulping. One of the reasons for using NSSC pulping is the high yield, typically above 60%. In NSSC pulping, the cooking liquor comprises sulfite, such as $Na_2SO_3$ or $(NH_4)_2SO_3$ and a base, such as NaOH or $Na_2CO_3$. "Neutral" means that the pH of the NSSC cooking liquor is generally between 6 and 10. The pulp can be cooked in a batch or continuous cooker. Normally, the cooking time is between 5 minutes and 3 hours and the cooking temperature is 160-200° C. The NSSC pulp comprises comparatively high amounts of residual lignin, such as 15-20%, which makes the NSSC pulp stiff. The Kappa number of the NSSC pulp is typically above 70. The NSSC pulping is "semi-chemical" in the sense that it also comprises mechanical refining of the pulp. Refining may for example be done using a disc refiner at digester pressure or at atmospheric pressure.

A multi-ply liner typically comprises a first ply, intended as the top or print layer, comprised mainly of unbleached kraft pulp (UBKP), and a second ply, intended as the back ply facing the fluting in a corrugated board, comprising recycled cellulose fiber pulp and having a low content of UBKP.

The present invention is based on the inventive realization that a washed NSSC pulp, having a low ash content of less than 1.8 wt %, as determined according to standard ISO 1762:2019, may advantageously be used in high amounts in the back ply of a multi-ply liner. Washing of the NSSC pulp has been found to reduce the negative impact on wet end chemistry and problems with webs breaks associated with unwashed NSSC pulp. The washed NSSC pulp in the second ply can improve the strength of the liner, especially in liners wherein the washed NSSC pulp is used to replace recycled cellulose fibers (e.g. testliner). The washed NSSC pulp in the second ply also reduces the consumption of the more expensive UBKP, thereby reducing the cost of the liner. Using washed NSSC pulp in the second ply allows for high amounts of NSSC, such as 50% or more of the total fiber content of the second ply, to be used.

According to a first aspect illustrated herein, there is provided a multi-ply liner for use in food or beverage packaging materials, said multi-ply liner comprising:

a first ply, and a second ply, wherein said first ply comprises at least 70 wt % unbleached kraft pulp and less than 30 wt % neutral sulfite semi chemical (NSSC) pulp based on dry weight, wherein said second ply comprises at least 50 wt % NSSC pulp and less than 50 wt % unbleached kraft pulp based on dry weight, and wherein said NSSC pulp in the second ply is a washed NSSC pulp which has an ash content of less than 1.8 wt %, as determined according to standard ISO 1762:2019.

"NSSC pulp" is obtained from "NSSC pulping", which in turn is defined in the background section. The NSSC pulp can be hardwood pulp or softwood pulp, or a mixture thereof. The NSSC pulp is preferably hardwood pulp or a hardwood/softwood pulp mixture with less than 15 wt % softwood, preferably less than 10 wt % softwood, and more preferably less than 5 wt % softwood. The hardwood may for example be aspen, alder, poplar, *eucalyptus*, birch, acacia, or beech. The NSSC pulp is preferably prepared cooked using a cooking liquor comprising sulfite, preferably $Na_2SO_3$ or $(NH_4)_2SO_3$ and a base, preferably NaOH or $Na_2CO_3$. In some embodiments the yield from the NSSC pulping is above 60%, preferably above 65%, preferably above 70%, and more preferably above 75%. The term "neutral" means that the pH of the NSSC cooking liquor is in the range of 6-10. The cooking time preferably in the range of 5 minutes to 3 hours. The cooking temperature is preferably in the range of 160-200° C. The NSSC pulp May comprise comparatively high amounts of residual lignin, such as 15-20%. The Kappa number of the NSSC pulp is typically above 70, preferably above 80, preferably above 95, and more preferably above 100, according to ISO 3260. The NSSC pulping is "semi-chemical" in the sense that it also comprises mechanical refining of the pulp. Refining may for example be done using a disc refiner at digester pressure or at atmospheric pressure. The refining can be done in one or more steps at the same or different pulp consistencies. A first refining step may preferably be done at higher consistency such as 5-35%, and a second refining step may preferably be done at lower consistency <5%.

The low ash content of the washed NSSC pulp can be achieved by washing of the pulp. The ash content can also be reduced by more efficient removal of bark prior to the pulping process.

In some embodiments, said NSSC pulp has been subjected to washing to reduce the ash content. The purpose of washing is to separate the pulp from black liquor to wash out the residual substances such as alkali-lignin produced in the cooking process, and purify the pulp. In some embodiments, the washing of the NSSC pulp comprises diluting the NSSC pulp using >10 $m^3$, preferably >12 $m^3$, and more preferably >15 $m^3$, of clean water per tn of dry NSSC pulp and then subjecting the pulp to dewatering to a solid content >40 wt %. In some embodiments, the washing of the NSSC pulp comprises diluting the NSSC pulp using 10-50 $m^3$, preferably 12-50 $m^3$, and more preferably 15-50 $m^3$, of clean water per tn of dry NSSC pulp and then subjecting the pulp to dewatering to a solid content >40 wt %. The washing can be performed in one or more washing steps, each washing step comprising diluting to the NSSC pulp and then subjecting the pulp to dewatering. The washing can be done using one or more conventional pulp washing methods and washing equipment, including, but not limited to a rotary vacuum washer, a rotary pressure washer, a pressure and atmospheric diffusion washer, a horizontal belt washer and/or dilution/extraction equipment. Washing typically involves diluting the NSSC pulp with water, and subsequently removing the water together with diluted colloidal substances, salts, impurities, and fines through a wire. A preferred washing procedure uses at least one twin wire, drum displacement washer, twin roll press, rotary vacuum drum washer, rotary pressurized drum, horizontal belt presses, atmospheric or pressurized diffusers, or extraction presses, followed by at least one pulp screw press.

In some embodiments, at least one washing step, preferably the last washing step, is performed with hot water. The temperature of the hot water is preferably above 50° C., more preferably above 60° C. or above 70° C. In some embodiments, the temperature of the hot water is in the range of 50-100° C., 60-100° C. or 70-100° C. In some embodiments the pulp temperature in the washing step performed with hot water is in the range of 40-90° C. or in the range of 45-80° C.

The washing of the NSSC pulp can be characterized in terms of the Norden efficiency factor (E), preferably the Norden efficiency factor normalized to 10% discharge consistency ($E_{10}$). $E_{10}$ can be calculated by the formula:

$$E_{10} = \frac{\ln\left[\frac{L_0(x_1 - y_2)}{L_1(x_0 - y_1)}\right]}{\ln(1 + DF/9)}$$

Wherein:

$L_0$=pulp inlet liquid, lb/lb pulp $L_1$=pulp outlet liquid, lb/lb pulp $x_0$=pulp inlet solids concentration, wt %

$x_1$=pulp outlet solids concentration, wt %

$y_1$=washing liquor outlet solids concentration, wt %

$y_2$=washing liquor inlet solids concentration, wt %

DF=dilution factor=$V_2$–$L_1$ $V_2$=shower water flow, lb/lb pulp

In some embodiments, the Norden efficiency factor of the washing step normalized to 10% discharge consistency ($E_{10}$) is >2, preferably >2.2, and more preferably >2.5.

In some embodiments, the Norden efficiency factor of the washing step normalized to 10% discharge consistency ($E_{10}$) is in the range of 2-6, preferably 2.2-5, and more preferably 2.5-4.

When washing is performed in two or more washing steps in series, the $E_{10}$ values are additive. I.e. a washing sequence consisting of a first washing step having an $E_{10}$ value of 2 and a second washing step having an $E_{10}$ value of 1 results in a total $E_{10}$ value of 3.

In some embodiments, the NSSC pulp has been prepared from wood comprising less than 3 wt %, less than 2.5 wt %, less than 2 wt %, or preferably less than 1 wt % or less than 0.8 wt % bark.

The washed NSSC pulp of the inventive multi-ply liner has an ash content of less than 1.8 wt %. The ash content can be measured according to standard ISO 1762:2019. In some embodiments, said NSSC pulp has an ash content of less than 1.6 wt %, preferably less than 1.4 wt %, and more preferably less than 1.2 wt % or less than 1.0 wt % or less than 0.9 wt %, as determined according to standard ISO 1762:2019.

The ash content, representing the washing efficiency and purity of the NSSC pulp, can also be measured by measuring the hot water extract conductivity of the NSSC pulp according to ISO 6587. In some embodiments, the washed NSSC pulp has a hot water extract conductivity of less than 30 mS/cm, preferably less than 20 mS/cm, and more preferably less than 15 mS/cm, as determined according to ISO 6587.

In some embodiments, the conductivity of the washed NSSC pulp is less than 1200, less than 1000, less than 800, or less than 600, and more preferably less than 500, less than 450, less than 400, less than 350 or less than 300 mS/m, when disintegrated at 3.5 wt % in distilled water.

In some embodiments, the washed NSSC pulp comprises less than 2%, preferably less than 1.8%, more preferably less than 1.6%, Pulmac shives (slot size 0.1 mm).

In addition to reducing the ash content, the washing may also lead to a reduction of the content of cellulose fines in the washed NSSC pulp. The term cellulose fines as used herein generally refers to cellulosic particles significantly smaller in size than cellulose fibers. In some embodiments, the term fines as used herein refers to fine cellulosic particles, which are able to pass through a 200 mesh screen (equivalent hole diameter 76 μm) of a conventional laboratory fractionation device (SCAN-CM 66:05). The reduction of fines in the washed NSSC pulp may for example be in the range of 0.1-10 wt %, or in the range of 0.5-7 wt %.

During preparation of semichemical pulp, such as NSSC, dissolved organic substances are formed. These dissolved organic substances are typically measured as chemical oxygen demand (COD) according to the standard NF T90-101 (referred to herein as COD/$t_{90}$). Typically, after preparation of semichemical pulp, values of at least 120 kg COD/$t_{90}$ are obtained, in some cases even higher than 150 or 180 kg COD/$t_{90}$. In addition, significant amount of dissolved organic substances may be formed during further defibrillation and refining of the pulp. Depending on the refining conditions, an additional 10-100 kg COD/$t_{90}$ or more may be formed. There is a need to optimize the washing of semichemical pulps such as NSSC to reduce the COD/$t_{90}$. Preferably the washed NSSC pulp comprises less than 30 kg COD/$t_{90}$, more preferably less than 20 kg COD/$t_{90}$ and most preferably less than 10 kg COD/$t_{90}$.

The first ply of the multi-ply liner comprises at least 70 wt % unbleached kraft pulp (UBKP). In some embodiments, said first ply comprises at least 75 wt %, preferably at least 80 wt %, unbleached kraft pulp based on dry weight. The first ply may comprise 100 wt % UBKP, but more commonly, the ply may also comprise other components, such that the first ply comprises 95 wt % or less, 90 wt % or less, or 85 wt % or less, UBKP based on dry weight. It is preferred that the multi-ply liner comprises 70-95 wt %, preferably 80-90 wt % of unbleached kraft pulp based on dry weight.

Unbleached kraft pulp, or UBKP, generally refers to an unbleached sulphate pulp based on pine and/or spruce. The main raw material of the UBKP is preferably pine, but it can also contain up to 45 wt % spruce. In some embodiments, the UBKP has a Kappa number above 55, preferably above 60, and more preferably above 70, as determined according to SCAN ISO C-1.

The first ply may further comprise NSSC pulp, but at a lower content than the second ply. The first ply comprises less than 30 wt % NSSC pulp based on dry weight. Preferably, the first ply comprises less than 20 wt % or less than 10 wt % NSSC pulp based on dry weight. It is preferred that the first ply comprise between 5-30 wt %, preferably between 5-20 wt % or even more preferred between 5-10 wt % of NSSC pulp based on dry weight. In some embodiments, the first ply is free from NSSC pulp.

The part of the first ply not being UBKP or NSSC pulp, may comprise any kind of fibers, such as hardwood and/or softwood fibers and may include, e.g., chemical pulp, mechanical pulp, thermomechanical pulp or chemi-thermomechanical pulp (CTMP). In some embodiments, the liner is a kraftliner, and the part of the first ply not being UBKP is made entirely from virgin fibers. The part of the first ply not being UBKP may also for example comprise recycled cellulose fibers. For example, the first ply of the present disclosure may consist essentially of UBKP or a mixture of UBKP and recycled cellulose fibers. "Recycled cellulose fibers" refers to fiber material that has previously been incorporated in some paper or board product. The recycled fibers are preferably pre-consumer recycled fibers or broke obtained from the board manufacturing process. Alternatively, or as a complement, the part of the pulp not being UBKP may for example comprise reject pulp. For example, the pulp of the present disclosure may consist essentially of UBKP and reject pulp. "Reject pulp" refers to pulp prepared by refining the screen reject from another process.

In some embodiments, the first ply of the multi-ply liner is optimized to provide a good printing surface and good moisture resistance. In some embodiments, the optimization to provide a good printing surface and good moisture resistance includes surface sizing. In some embodiments the multi-ply liner is surface sized. In some embodiments the multi-ply liner is surface sized with starch. In some embodiments the multi-ply liner is surface sized with a combination of starch and at least one other functional component, preferably selected from the group consisting of a crosslinker, a reinforcing agent, and a hydrophobizing sizing agent. The crosslinker may for example be selected from the group consisting of metal salts, such as zirconium carbonate, glyoxal or modified glyoxals, aminoplast resins, formaldehyde, melamine, and modified melamines. In some embodiments the crosslinker is citric acid. The reinforcing agent may for example be microfibrillated cellulose (MFC). The hydrophobizing sizing agent may for example be alkyl ketene dimer (AKD), alkenyl succinic anhydride (ASA), SMA (Styrene Maleic Anhydride), a rosin size, or mixtures thereof.

The second ply comprises at least 50 wt % of washed NSSC pulp based on dry weight. The second ply comprises a significantly higher content of NSSC pulp than the first ply. In some embodiments, said second ply comprises at least 60 wt %, preferably at least 70 wt %, more preferably at least 80 wt %, of washed NSSC pulp based on dry weight. The second ply may consist entirely of the washed NSSC pulp, but more commonly, the second ply may also comprise other components, such that the second ply comprises 95 wt % or less, 90 wt % or less, 85 wt % or less, 80 wt % or less, or 75 wt % or less, of washed NSSC pulp, based on dry weight.

The second ply may also comprise UBKP, but the second ply comprises a significantly lower content of UBKP than the first ply. The second ply comprises less than 50 wt % UBKP based on dry weight. Preferably, the second ply comprises less than 40 wt %, less than 30 wt %, or less than 20 wt %, UBKP based on dry weight. It is preferred that the second ply comprise between 5-50 wt %, even more preferred between 5-40 wt % or between 5-30 wt % of UBKP based on dry weight.

The part of the second ply not being washed NSSC pulp or UBKP, may comprise any kind of fibers, such as hardwood and/or softwood fibers and may include, e.g., chemical pulp, mechanical pulp, thermomechanical pulp or chemi-thermomechanical pulp (CTMP). In some embodiments, the liner is a kraftliner, and the part of the second ply not being washed NSSC pulp is made entirely from virgin fibers. Thus, in some embodiments the second ply is free from recycled fibers.

In some embodiments the part of the second ply not being washed NSSC pulp may comprise recycled cellulose fibers. For example, the second ply of the present disclosure may consist essentially of washed NSSC pulp or a mixture of washed NSSC pulp and recycled cellulose fibers. "Recycled cellulose fibers" refers to fiber material that has previously been incorporated in some paper or board product. The recycled fibers are preferably pre-consumer recycled fibers or broke obtained from the board manufacturing process. Alternatively, or as a complement, the part of the pulp not being washed NSSC pulp may for example comprise reject pulp. For example, the pulp of the present disclosure may consist essentially of washed NSSC pulp and reject pulp. "Reject pulp" refers to pulp prepared by refining the screen reject from another process.

The addition of washed NSSC pulp in the second ply can improve the strength of the liner, especially in multi-ply liners wherein the washed NSSC pulp is used to replace recycled fibers. In some embodiments, less than 30 wt % of the second ply is made up of broke or recycled cellulose fibers.

The liner of the present disclosure is a multi-ply liner comprising a first ply (also referred to as the top ply), and a second ply (also referred to as the back ply). The outer surfaces of the multi-ply liner, i.e. the surfaces of the top and back ply facing away from the other ply, are referred to as top side and back side respectively.

The liner can be manufactured in a paper or paperboard machine adapted for manufacturing of multi-ply liner. Paper or paperboard machines for making multi-ply liner are well known in the art. Typically, the machine layout comprises a stock handling section, a wet end section, a pressing and drying section and a calendering and/or coating section. In the wet end section, the plies of the multi-ply liner may be formed individually, using different headboxes and laminated in a wet state, or formed together using a multiply headbox. If formed individually, the plies are typically laminated, or couched together, before the press and drying section of the paper machine.

In some embodiments, the grammage of each of the first ply and the second ply of the multi-ply liner is in the range of 20-150 g/m$^2$, preferably in the range of 30-100 g/m$^2$. The total grammage of the multi-ply liner is preferably in the range of 40-300 g/m$^2$.

In some embodiments, the multi-ply liner further comprises a strengthening or adhesive agent applied at the interface between the first ply and the second ply. Preferably, this strengthening or adhesive agent comprises cooked or gelatinzed or uncooked starch, or a mixture of cooked or gelatinzed or uncooked starch with microfibrillated cellulose (MFC). A preferred strengthening or adhesive agent is cooked native starch or cooked native starch mixed with microfibrillated cellulose. In some embodiments, the strengthening or adhesive agent further comprises a crosslinker. The crosslinker may for example be selected from the group consisting of metal salts, such as zirconium carbonate, glyoxal or modified glyoxals, aminoplast resins, formaldehyde, melamine, and modified melamines. In some embodiments the crosslinker is citric acid. In some embodiments, the strengthening or adhesive agent further comprises an insolubilizer. The insolubilizer may for example be an amino resin, glyoxal, or zirconium salt insolubilizer. The amount of strengthening or adhesive agent applied at the interface between the second ply and the second ply is preferably in the range of 0.1-5 g/m$^2$, more preferably in the range of 0.5-3 g/m$^2$, based on dry weight.

Due to the high content of washed NSSC pulp in the second ply, the multi-ply liner overall has a high content of washed NSSC pulp. In some embodiments, the amount of washed NSSC pulp in the multi-ply liner is at least 10 wt %, preferably at least 20 wt %, more preferably at least 30 wt % based on dry weight. In some embodiments, the amount of washed NSSC pulp in the multi-ply liner is at least 40 wt %, preferably at least 50 wt %, more preferably at least 60 wt % based on dry weight.

In some embodiments, the washed NSSC pulp used in the multi-ply liner is a fractionated washed NSSC pulp. Fractionated washed NSSC pulp is obtained by size fractionation of a washed NSSC pulp starting material into a fine fiber fraction and a coarse fiber fraction. Compared to the starting material, the fine fiber fraction has a higher amount of shorter and thinner fibers. In other words, the average particle size of the washed NSSC pulp of the fine fiber fraction is lower than the average particle size of the washed NSSC pulp of the coarse fiber fraction. The fine fiber fraction may for example be obtained by separating the washed NSSC pulp starting material in pressure screens to achieve a fraction with shorter and thinner fibers.

The fine fiber fraction obtained by size fractionation of a washed NSSC pulp is especially advantageous for use in the first ply of the multi-ply liner, intended as the top or print layer, since it has less effect on the optical properties of the liner as compared to an unfractionated or coarse fiber fraction of the washed NSSC pulp. The coarse fiber fraction may advantageously be used in the second ply, where it does not affect the optical properties of the liner. In a preferred embodiment, the washed NSSC pulp used in the first ply is the fine fiber fraction of a fractionated NSSC. The first ply is preferably free from NSSC shives. In a preferred embodiment, the washed NSSC pulp used in the second ply is the coarse fraction of a fractionated washed NSSC pulp. In some embodiments, the average particle size of the washed NSSC pulp used in the first ply is lower than the average particle size of the washed NSSC pulp used in the second ply. In some embodiments, the average particle size is the length weighted mean fiber measured according to the standard ISO 16065-2 using an FS5 optical fiber analyzer (Valmet).

In some embodiments, said multi-ply liner further comprises an internal sizing agent. The internal sizing agent is preferably a hydrophobizing sizing agent. In some embodiments, the internal sizing agent is selected form the group consisting of alkyl ketene dimer (AKD), alkenyl succinic anhydride (ASA), rosin sizes, and mixtures thereof. In some embodiments, the amount of the internal sizing agent in the multi-ply liner is in the range of 0.5-6 kg/tn, preferably in the range of 0.8-4 kg/tn, and more preferably in the range of 1-3 kg/tn, based on dry weight.

In some embodiments, at least one side, preferably the top side, of the multi-ply liner has a Cobb 30 s value below 40, preferably below 25, and more preferably below 22, as determined according to standard ISO 535.

In some embodiments, said multi-ply liner has an equilibrium moisture content (EMC) of less than 10 wt %, preferably less than 8 wt % at 50% RH, as determined according to standard ISO 287.

The multi-ply liner may further comprise additives such as native starch or starch derivatives, cellulose derivatives such as sodium carboxymethyl cellulose, a filler, retention and/or drainage chemicals, flocculation additives, deflocculating additives, dry strength additives, softeners, cross-linking aids, sizing chemicals, dyes and colorants, wet strength resins, fixation agents, de-foaming aids, microbe and slime control aids, or mixtures thereof.

In some embodiments, all pulps used in the multi-ply liner are formed from FSC certified wood.

In some embodiments, the multi-ply liner complies with the BfR XXXVI recommendations for paper and board for food contact as of 1 Apr. 2021.

The multi-ply liner may further comprise a third ply wherein said third ply comprises at least 70 wt % unbleached kraft pulp and between 5-30 wt %, preferably between 5-20 wt % or even more preferred between 5-10 wt % neutral sulfite semi chemical (NSSC) pulp based on dry weight. It is preferred that the third ply has the same composition as the first ply. I may be preferred that the first and third plies of the multi-ply liner will form the outer plies and the second ply form the mid-ply of the multiply liner. The NSSC pulp of the third ply preferably also is washed.

In some embodiments it is preferred that the multi-ply liner is a 2-ply liner. The 2-ply liner comprises only two cellulose based plies, i.e. only said first and second plies.

According to a second aspect illustrated herein, there is provided a method for manufacturing a multi-ply liner for use in food or beverage packaging materials, comprising the steps of:

a) forming a first web layer from a first pulp suspension and dewatering said first web layer to obtain a first ply;

b) forming a second web layer from a second pulp suspension and dewatering said second web layer to obtain a second ply on the first ply;

wherein said first pulp suspension comprises at least 70 wt % unbleached kraft pulp and less than 30 wt % neutral sulfite semi chemical (NSSC) pulp based on dry weight, and wherein said second pulp suspension comprises at least 50 wt % NSSC pulp and less than 50 wt % unbleached kraft pulp based on dry weight, and wherein said NSSC pulp in the second pulp suspension is a washed NSSC pulp which has an ash content of less than 1.8 wt %, as determined according to standard ISO 1762:2019.

In some embodiments, the step b) further comprises the steps:

b1) providing a raw NSSC pulp having an ash content of at least 2 wt %, as determined according to standard ISO 1762:2019;

b2) washing the raw NSSC pulp to obtain a washed NSSC pulp having an ash content of less than 1.8 wt %, as determined according to standard ISO 1762:2019; and b3) optionally mixing the washed NSSC pulp with at least one internal sizing agent;

to obtain the washed neutral sulfite semi chemical (NSSC) pulp of the second pulp suspension.

The purpose of washing is to separate the pulp from black liquor to wash out the residual substances such as alkali-lignin produced in the cooking process, and purify the pulp.

In some embodiments, the step b2) comprises diluting the raw NSSC pulp with water, and subsequently removing the water together with diluted colloidal substances, salts, impurities, and fines through a wire.

In some embodiments, the washing of the NSSC pulp comprises diluting the NSSC pulp using >10 $m^3$, preferably >12 $m^3$, and more preferably >15 $m^3$, of clean water per tn of dry NSSC pulp and then subjecting the pulp to dewatering to a solid content >40 wt %. In some embodiments, the washing of the NSSC pulp comprises diluting the NSSC pulp using 10-50 $m^3$, preferably 12-50 $m^3$, and more preferably 15-50 $m^3$, of clean water per tn of dry NSSC pulp and then subjecting the pulp to dewatering to a solid content >40 wt %. The washing can be performed in one or more washing steps, each washing step comprising diluting to the NSSC pulp and then subjecting the pulp to dewatering. The washing can be done using one or more conventional pulp washing methods and washing equipment, including, but not limited to a rotary vacuum washer, a rotary pressure washer, a pressure and atmospheric diffusion washer, a horizontal belt washer and/or dilution/extraction equipment. Washing typically involves diluting the NSSC pulp with water, and subsequently removing the water together with diluted colloidal substances, salts, impurities, and fines through a wire. A preferred washing procedure uses at least one twin wire, drum displacement washer, twin roll press, rotary vacuum drum washer, rotary pressurized drum, horizontal belt presses, atmospheric or pressurized diffusers, or extraction presses, followed by at least one pulp screw press.

In some embodiments, at least one washing step, preferably the last washing step, is performed with hot water. The temperature of the hot water is preferably above 50° C., more preferably above 60° C. or above 70° C. In some embodiments, the temperature of the hot water is in the range of 50-100° C., 60-100° C. or 70-100° C. In some embodiments the pulp temperature in the washing step performed with hot water is in the range of 40-90° C. or in the range of 45-80° C.

In some embodiments, the step b2) comprises washing the raw NSSC pulp to obtain a washed NSSC pulp having an ash content of less than 1.6 wt %, preferably less than 1.4 wt %, and more preferably less than 1.2 wt % or less than 1.0 wt % or less than 0.9 wt %, as determined according to standard ISO 1762:2019.

The washing of the NSSC pulp can be characterized in terms of the Norden efficiency factor (E), preferably the Norden efficiency factor normalized to 10% discharge consistency ($E_{10}$). $E_{10}$ can be calculated by the formula:

$$E_{10} = \frac{\ln\left[\frac{L_0(x_1 - y_2)}{L_1(x_0 - y_1)}\right]}{\ln(1 + DF/9)}$$

Wherein:

$L_0$=pulp inlet liquid, lb/lb pulp $L_1$=pulp outlet liquid, lb/lb pulp $x_0$=pulp inlet solids concentration, wt %

$x_1$=pulp outlet solids concentration, wt %

$y_1$=washing liquor outlet solids concentration, wt %

$y_2$=washing liquor inlet solids concentration, wt %

DF=dilution factor=$V_2-L_1$ $V_2$=shower water flow, lb/lb pulp

In some embodiments, the Norden efficiency factor of the washing step normalized to 10% discharge consistency ($E_{10}$) is >2, preferably >2.2, and more preferably >2.5.

In some embodiments, the Norden efficiency factor of the washing step normalized to 10% discharge consistency ($E_{10}$) is in the range of 2-6, preferably 2.2-5, and more preferably 2.5-4.

When washing is performed in two or more washing steps in series, the $E_{10}$ values are additive. I.e. a washing sequence consisting of a first washing step having an $E_{10}$ value of 2 and a second washing step having an $E_{10}$ value of 1 results in a total $E_{10}$ value of 3.

In some embodiments, the step b2) comprises washing the raw NSSC pulp to obtain a washed NSSC pulp having a hot water extract conductivity of less than 30 mS/cm, preferably less than 20 mS/cm, and more preferably less than 15 mS/cm, as determined according to ISO 6587.

The terms first and second web layer do not necessarily denote the order in which the web layers are formed. The web layers can be formed simultaneously or individually, in any order.

In some embodiments, the first and second web layer are formed and partially dewatered individually, using different headboxes and one or more wires, and subsequently laminated in a wet state.

In some embodiments, the first and second web layer are formed and partially dewatered together using a multiply headbox and a single wire.

For example, the first web layer may be formed and partially dewatered individually, and subsequently laminated in a wet state with the second web layer to obtain a second ply on the first ply. Alternatively, the second web layer may be formed and dewatered together with the first web layer.

In some embodiments, said first pulp suspension comprises at least 75 wt %, preferably at least 80 wt %, unbleached kraft pulp based on dry weight.

In some embodiments, said first pulp suspension comprises less than 20 wt %, preferably less than 10 wt %, washed NSSC pulp based on dry weight. Preferably the first pulp suspension comprises between 5-20 wt % of washed NSSC pulp based on dry weight, or even more preferred between 5-10 wt %.

In some embodiments, said second pulp suspension comprises at least 60 wt %, preferably at least 70 wt %, more preferably at least 80 wt %, washed NSSC pulp based on dry weight.

In some embodiments, at least 30% of the pulp of the second pulp suspension is made up of recycled cellulose fibers.

In some embodiments, the grammage of each of the first ply and the second ply is in the range of 20-150 g/m$^2$, preferably in the range of 30-100 g/m$^2$.

In some embodiments, the amount of washed NSSC pulp in the multi-ply liner is at least 10 wt %, preferably at least 20 wt %, more preferably at least 30 wt % based on dry weight.

In some embodiments, the average particle size of the washed NSSC pulp used in the first pulp suspension is lower than the average particle size of the washed NSSC pulp used in the second pulp suspension.

The method comprises forming and dewatering a number of webs from pulp suspensions. Methods for forming and dewatering webs having multiple layers are well known in the art. The liner can be manufactured in a paper or paperboard machine adapted for manufacturing of multi-ply liner. Paper or paperboard machines for making multi-ply liner are well known in the art. Typically, the machine layout comprises a stock handling section, a wet end section, a pressing and drying section and a calendering and/or coating section.

The webs are generally formed and dewatered in a formed in a wet end section, comprising one or more wires as conventional in the field. The plies may be formed individually, using different headboxes and laminated in a wet state, or formed together in a multiply headbox. The web is typically formed in a gap former, but it may also be formed in a fourdrinier type former. If formed individually, the wet plies are typically laminated, or couched together, before the press and drying section of the paper machine.

Before the lamination, a strengthening or adhesive agent can be applied between the first ply and the second ply. Preferably, this strengthening or adhesive agent comprises cooked or gelatinzed or uncooked starch, or a mixture of cooked or gelatinzed or uncooked starch with microfibrillated cellulose (MFC). A preferred strengthening or adhesive agent is cooked native starch or cooked native starch mixed with microfibrillated cellulose. In some embodiments, the strengthening or adhesive agent further comprises a crosslinker. The crosslinker may for example be citric acid. In some embodiments, the strengthening or adhesive agent further comprises an insolubilizer. The insolubilizer may for example be an amino resin, glyoxal, or zirconium salt insolubilizer. The strengthening or adhesive agent is preferably added as a paste or an aqueous dispersion using a non-contact deposition technique, such as spray or foam or curtain application. Preferably, the solid content of the aqueous dispersion is in the range of 0.5-50 wt %, and more preferably in the range of 1-30 wt %. The amount of strengthening or adhesive agent applied is preferably in the range of 0.1-5 g/m$^2$, more preferably in the range of 0.5-3 g/m$^2$, based on dry weight.

The web is typically subjected to further dewatering, which may for example include passing the formed multilayer web through a press section of the paper machine, where the web passes between large rolls loaded under high pressure to squeeze out as much water as possible. The press section may constitute of traditional nip press units and press fabric felts and/or with one or several shoe presses or extended dewatering nips. These can be run at various nip or press loads including different positions, temperatures and delays times. The press section may be provided with one or more shoe presses to maximize production. If using one or several shoe presses, these can be run at press levels above 800 kN/m, such as above 1000 kN/m, such as above 1200 kN/m, or such as such as above 1450 kN/m. The removed water is typically received by a fabric or felt.

After the press section, the multilayer web may be subjected to drying in a drying section. The drying may for example include drying the multilayer web by passing the multilayer web around a series of heated drying cylinders. Drying may typically remove the water content down to a level of about 1-15 wt %, preferably to about 2-10 wt %.

According to a third aspect illustrated herein, there is provided a food or beverage packaging material, comprising a multi-ply liner according to the first aspect or obtained according to by a method according to the second aspect, wherein the first ply faces a print side of the packaging material and the second ply faces an inside of the packaging material.

In some embodiments, the food or beverage packaging material is a liquid packaging board, a food service board or a corrugated board.

In some embodiments, the food or beverage packaging material is a corrugated board. Corrugated board comprises at least one layer of liner, which is non-corrugated, which is glued to at least one layer of fluting. For example, corrugated board may consist of a layer of fluting sandwiched between two layers of liner. In preferred embodiments, the fluting is glued to the second ply of the multi-ply liner.

The multi-ply liner may also be used as a free-standing substrate, i.e. as a paperboard or cardboard which does not form part of a corrugated board. The free-standing substrate may for example used as the paper or paperboard substrate for a liquid packaging board (LPB) or a food service board (FSB). Thus, in some embodiments, the food or beverage packaging material is a liquid packaging board or a food service board. The multi-ply liner for use as a liquid packaging board (LPB) or a food service board (FSB) may further be coated with additional functional layers, such as a print receiving layer barrier or barrier layer or laminated with additional paper or plastic films.

In some embodiments, the food or beverage packaging material complies with the BfR XXXVI recommendations for paper and board for food contact as of 1 Apr. 2021.

According to a fourth aspect illustrated herein, there is provided a food or beverage packaging container, comprising a multi-ply liner according to the first aspect or obtained according to by a method according to the second aspect, wherein the first ply faces a print side of the packaging container and the second ply faces an inside of the packaging container.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

EXAMPLES

These examples demonstrate that high amounts of washed NSSC pulp can be used in a 2-ply liner without negatively affecting mechanical or optical properties of the liner. Three samples of 135 gsm 2-ply liner comprising UBKP in top ply and RCF, NSSC and washed NSSC, respectively, in the back ply were prepared and analyzed.

The washing of the NSSC pulp used was made by diluting to the NSSC pulp using >10 $m^3$ of clean water per tn of dry NSSC pulp. The pulp was then subjected to dewatering on a dewatering fabric to a solid content >40 wt %.

The qualitative and quantitative analysis of volatile organic compounds (VOC) for the samples was performed with a head space gas chromatography unit equipped with flame ionization detector (HS GC/FID or HS GC/MS).

The sample (2.0 g) was heated to 90° C. for 40 min in a closed sample vial, and evaporated (gaseous) compounds in the airspace above the sample were analyzed.

Amounts of total volatile compounds and hexanal were determined calculated. The compounds were identified by comparison to a spectral library 2-Ply Liner Preparation Method 2-ply linerboards comprising a top ply (corresponding to the first ply of the invention) and a back ply (corresponding to the second ply of the invention) were prepared on a pilot machine equipped with 2 headboxes and 2 wires, a press section, and a drying section. The target end moisture content for the 2-ply structures was 8 wt % and the target grammage was 135 g/$m^2$.

Example 1 (Comparative)—100% RCF in Back Ply

A 2-ply 135 g/$m^2$ linerboard was prepared according to the 2-ply liner preparation method described above using 100% unbleached kraft pulp (UBKP) in the top ply and 100% recycled cellulose fiber pulp (RCF) in the back ply as set out in Table 1. The liner was analyzed and the results are presented in Table 1. Ash content 1.3 wt %, SR 32, conductivity pH 6.6. The quantitative and qualitative determination of VOC gave a total amount of volatiles of 16100 ppb, and the amount of hexanal was 4060 ppb.

Example 2 (Comparative)—100% NSSC Pulp in Back Ply

A 2-ply 135 g/$m^2$ linerboard was prepared according to the 2-ply liner preparation method described above. In this example, the back-ply comprised 100% of unwashed NSSC pulp (1) as set out in Table 1. The liner was analyzed and the results are presented in Table 1.

Example 3—100% Washed NSSC Pulp in Back Ply

A 2-ply 135 g/$m^2$ linerboard was prepared according to the 2-ply liner preparation method described above. In this example, the back-ply comprised 100% of washed NSSC pulp (2) as set out in Table 1. The liner was analyzed and the results are presented in Table 1. Ash content 0 wt %, SR of the NSSC was 25, conductivity 1.32 mS/cm and pH 6.2. The quantitative and qualitative determination of VOC gave a total amount of volatiles of 9790 ppb, and the amount of hexanal was 3110 ppb. This shows that the washed NSSC pulp can provide a significant reduction in total VOC and in amount of hexanal.

TABLE 1

| | | Reference 1 | NSSC (not washed) 2 | NSSC (washed) 3 |
|---|---|---|---|---|
| Top ply | | 100 UBKP | 100 UBKP | 100 UBKP |
| Back ply | | 100 RCF | 100 NSSC (1) | 100 NSSC (2) |
| Grammage | g/$m^2$ | 135 | 135 | 135 |
| Moisture content | % | 8 | N.D. | 8 |
| Scott bond | J/$m^2$ | 277 | N.D. | 330 |
| SCT | KN/m | 2.9 | N.D. | 3.6 |
| Burst strength | kPa | 682 | N.D. | 788 |
| COBB | g/$m^2$ | 32 | N.D. | 29 |
| Roughness | ml/min | 544 | N.D. | 575 |

Unless otherwise stated, the physical properties discussed in the present disclosure are determined according to the following standards:

| | |
|---|---|
| Grammage | ISO 536 |
| Roughness | ISO 8791-2:2013 |
| Cobb 30 s | ISO 535 |
| Moisture content 50% rh | ISO 287 |
| Scott-Bond | TAPPI T569 |
| SCT | ISO 9895 |
| Burst index | ISO 2759 |
| Burst strength | ISO 2759 |

Unless otherwise stated, then the standard method can be applied for determining physical and mechanical properties in both cross direction (cd) and machine direction (md)

The invention claimed is:

1. A multi-ply liner for use in food or beverage packaging materials, said multi-ply liner comprising:

a first ply, and a second ply, wherein said first ply comprises at least 70 wt % unbleached kraft pulp and less than 30 wt % neutral sulfite semi chemical (NSSC) pulp based on dry weight, wherein said second ply comprises at least 50 wt % NSSC pulp and less than 50 wt % unbleached kraft pulp based on dry weight, and wherein said NSSC pulp in the second ply is a washed NSSC pulp which has an ash content of less than 1.8 wt %, as determined according to standard ISO 1762:2019.

2. The multi-ply liner according to claim 1, wherein the washed NSSC pulp has an ash content of less than 1.6 wt %, as determined according to standard ISO 1762:2019.

3. The multi-ply liner according to claim 1, wherein the washed NSSC pulp has a hot water extract conductivity of less than 30 mS/cm, as determined according to ISO 6587.

4. The multi-ply liner according to claim 1, wherein said first ply comprises at least 75 wt % unbleached kraft pulp based on dry weight.

5. The multi-ply liner according to claim 1, wherein said first ply comprises less than 20 wt % NSSC pulp based on dry weight.

6. The multi-ply liner according to claim 1, wherein said second ply comprises at least 60 wt %, preferably at least 70 wt %, more preferably at least 80 wt %, NSSC pulp based on dry weight.

7. The multi-ply liner according to claim 1, wherein less than 30 wt % of the second ply is made up of broke or recycled cellulose fibers.

8. The multi-ply liner according to claim 1, wherein a grammage of each of the first ply and the second ply is in a range of 20-150 g/m$^2$.

9. The multi-ply liner according to claim 1, wherein an amount of NSSC pulp in the multi-ply liner is at least 10 wt %, based on dry weight.

10. The multi-ply liner according to claim 1, wherein an average particle size of washed NSSC pulp used in the first ply is lower than an average particle size of the washed NSSC pulp used in the second ply.

11. The multi-ply liner according to claim 1, further comprising:

an internal sizing agent.

12. The multi-ply liner according to claim 1, wherein at least one side of said multi-ply liner has a Cobb 30 s value below 40, as determined according to standard ISO 535.

13. The multi-ply liner according to claim 1, wherein said multi-ply liner has an equilibrium moisture content (EMC) of less than 10 wt %, at 50% RH, as determined according to standard ISO 287.

14. The multi-ply liner according to claim 1, wherein the multi-ply liner is a 2-ply liner.

15. A method for manufacturing a multi-ply liner for use in food or beverage packaging material, comprising the steps of:

a) forming a first web layer from a first pulp suspension and dewatering said first web layer to obtain a first ply;

b) forming a second web layer from a second pulp suspension and dewatering said second web layer to obtain a second ply on the first ply;

wherein said first pulp suspension comprises at least 70 wt % unbleached kraft pulp and less than 30 wt % neutral sulfite semi chemical (NSSC) pulp based on dry weight, and wherein said second pulp suspension comprises at least 50 wt % NSSC pulp and less than 50 wt % unbleached kraft pulp based on dry weight, and wherein said NSSC pulp in the second pulp suspension is a washed NSSC pulp which has an ash content of less than 1.8 wt %, as determined according to standard ISO 1762:2019.

16. The method for manufacturing a multi-ply liner according to claim 15, wherein step b) further comprises the steps:

b1) providing a raw NSSC pulp having an ash content of at least 2 wt %, as determined according to standard ISO 1762:2019;

b2) washing the raw NSSC pulp to obtain a washed NSSC pulp having an ash content of less than 1.8 wt %, as determined according to standard ISO 1762:2019; and b3) optionally, mixing the washed NSSC pulp from step b2 with at least one internal sizing agent;

to obtain the washed neutral sulfite semi chemical (NSSC) pulp of the second pulp suspension.

17. The method for manufacturing a multi-ply liner according to claim 16, wherein step b2 comprises:

diluting the NSSC pulp with water, and subsequently removing the water together with diluted colloidal substances, salts, impurities, and fines through a wire.

18. The method for manufacturing a multi-ply liner according to claim 16, wherein step b2 comprises washing the raw NSSC pulp to obtain a washed NSSC pulp having an ash content of less than 1.6 wt %, as determined according to standard ISO 1762:2019.

19. The method for manufacturing a multi-ply liner according to claim 16, wherein step b2 comprises washing the raw NSSC pulp to obtain a washed NSSC pulp having a hot water extract conductivity of less than 30 mS/cm, as determined according to ISO 6587.

20. A food or beverage packaging material, comprising:

the multi-ply liner according to claim 1, wherein the first ply faces a print side of the food or beverage packaging material and the second ply faces an inside of the food or beverage packaging material.

21. The food or beverage packaging material according to claim 20, wherein the food or beverage packaging material is a liquid packaging board, a food service board or a corrugated board.

22. A food or beverage packaging container, comprising:

the multi-ply liner according to claim 1, wherein the first ply faces a print side of the food or beverage packaging container and the second ply faces an inside of the food or beverage packaging container.

* * * * *